United States Patent [19]

Kaltmann et al.

[11] Patent Number: 4,696,234

[45] Date of Patent: Sep. 29, 1987

[54] DEVICE FOR DESTROYING WATER MINES AND MINE-SWEEPING METHOD

[75] Inventors: Hans-Joachim Kaltmann, Düsseldorf; Hermann Schaper, Vallendar, both of Fed. Rep. of Germany

[73] Assignee: Rheinmetall GmbH, Duesseldorf, Fed. Rep. of Germany

[21] Appl. No.: 894,405

[22] Filed: Aug. 7, 1986

[30] Foreign Application Priority Data

Aug. 7, 1985 [DE] Fed. Rep. of Germany ..... 3528329

[51] Int. Cl.[4] ..... F42B 1/02; F42B 23/26

[52] U.S. Cl. ..... 102/308; 102/310; 102/412; 102/422; 102/425; 102/426; 89/1.14; 114/221 A

[58] Field of Search ..... 89/1.14; 102/306–310, 102/406, 412, 414, 416, 420, 422, 424, 425, 426; 114/221 A

[56] References Cited

U.S. PATENT DOCUMENTS

| | | | |
|---|---|---|---|
| 3,844,244 | 10/1974 | White | 114/221 A |
| 3,882,811 | 5/1975 | Temple | 114/221 A |
| 4,020,780 | 5/1977 | Shumaker et al. | 102/402 X |
| 4,126,092 | 11/1978 | Cross | 89/1.14 X |
| 4,128,071 | 12/1978 | Layman et al. | 89/1.14 X |
| 4,185,550 | 1/1980 | Vogt et al. | 102/413 |
| 4,495,849 | 1/1985 | Cooke et al. | 114/221 A X |
| 4,606,293 | 8/1986 | Kirkland | 89/1.14 X |

*Primary Examiner*—Peter A. Nelson

[57] ABSTRACT

This invention relates to an apparatus for destroying sea mines, especially anchored cable mines, and to an improved mine-sweeping method. The apparatus consists of an active device and upthrust mechanisms which permit the active device to climb up the anchor chain to the mine, which, once encountered, is destroyed. In one preferred embodiment, the device comprises a hollow charge carrier with rocket propulsion which is temporarily secured to a towing device, such as a towing cable. The device is released when it encounters the anchor chain of a mine, it rises along the chain, and then destroys the mine.

16 Claims, 9 Drawing Figures

65
64
68

65
64
60
63
62
62
63
6c
6c 600
61

67
66

DEVICE FOR DESTROYING WATER MINES AND MINE-SWEEPING METHOD

This invention relates to an apparatus for destroying sea mines, especially anchored cable mines, and to an improved mine-sweeping method. The apparatus consists of an active device and upthrust mechanisms which permit the active device to climb up the anchor chain to the mine, which, once encountered, is destroyed. In one preferred embodiment, the device comprises a hollow charge carrier with rocket propulsion which is temporarily secured to a towing device, such as a towing cable. The device is released when it encounters the anchor chain of a mine, it rises along the chain, and then destroys the mine.

BACKGROUND OF THE INVENTION

Mine sweepers and destructive devices are known in the art. For example, skilled practitioners are familiar with devices such as those disclosed in Sabranski, et al., U.S. Pat. No. 4,120,246. Sabranski discloses a device for combatting cable mines which is designed only to run through the cable itself. The known device combines a pyrotechnic charge inserted in a gripper jaw. These charges are strung along a line, at some distance from each other and in considerable numbers, and they are dragged or "swept" through a min-infested area by a vessel. When the gripper jaw encounters a mine cable the charge is triggered and the cable is destroyed by the charge. Under traditional systems such as this, the mine is cut loose by the device, and once it surfaces, the mine must be eliminated by some additional means, such as by shooting at the mine or applying an explosive charge.

SUMMARY OF THE INVENTION

It is an object of this invention to improve anti-mine tactics by providing a method and device that not only permits the cutting of mine chains or cables, but also destroys the mines themselves. Although invention is preferably applied to cable mines, it may be applied to other types of mines as well. This and other objects of the invention, which will become apparent from the following description, are achieved by means of a novel undersea device comprising a plurality of interrelated components.

The invention is further described with reference to a number of drawings and examples. It will be understood by skilled practitioners that these are illustrative only, and do not serve to limit the scope of the invention, the disclosure, or the appended claims.

DETAILED DESCRIPTION

Figure 1:
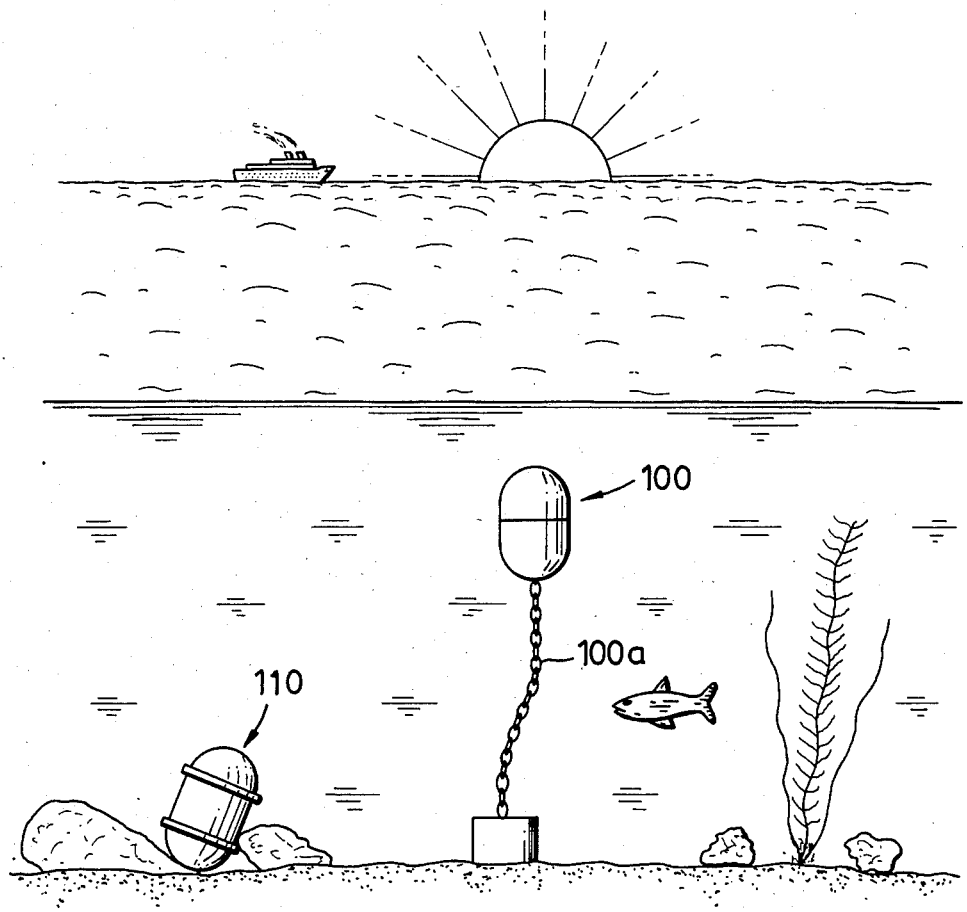
FIG. 1 is a schematic representation of an area at sea which is infested with nautical weapons such as ground and cable mines.
Figure 2:
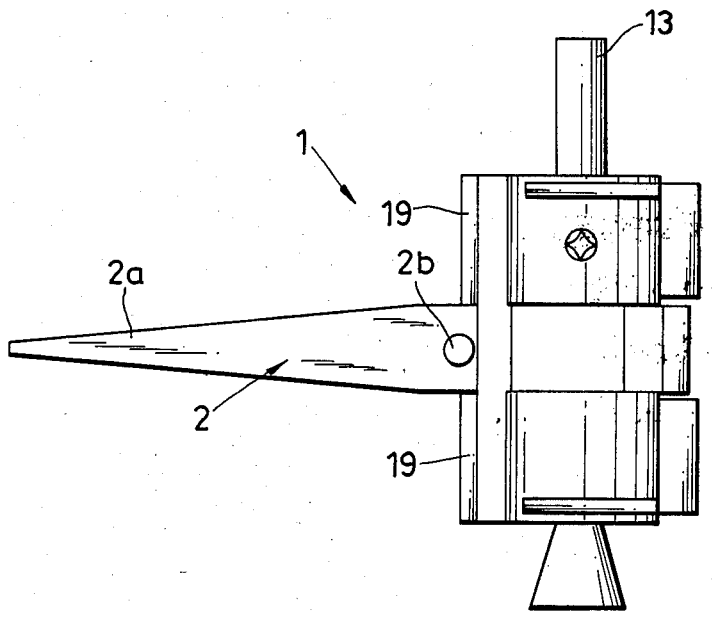
FIG. 2 is a front view of an embodiment of the invention.

FIG. 1 shows how the device according to the invention is deployed in a body of water to be cleared of ground mines 110 and cable mines 100. The invention serves to clear the area of this nautical weaponry, especially the cable mines 100, and the body of water is thereby rendered safe for navigation.

FIGS. 2–5 show a preferred embodiment of the invention. The new device 1 is dragged through an area to be cleared of nautical weaponry by dragging units 2, in much the same manner as the conventional explosive cable cutter. The dragging units 2 comprises a line **2*b* and a stabilizing fin 2*a*. Upon contact with the cable or chain 100*a* of an anchored cable mine 100, the device 1 separates from the dragging units 2, establishes a form-locking bond with the cable 100*a*, and moves upward along the cable 100*a* to the mine 100 in order to destroy the mine 100**.

Figure 3:
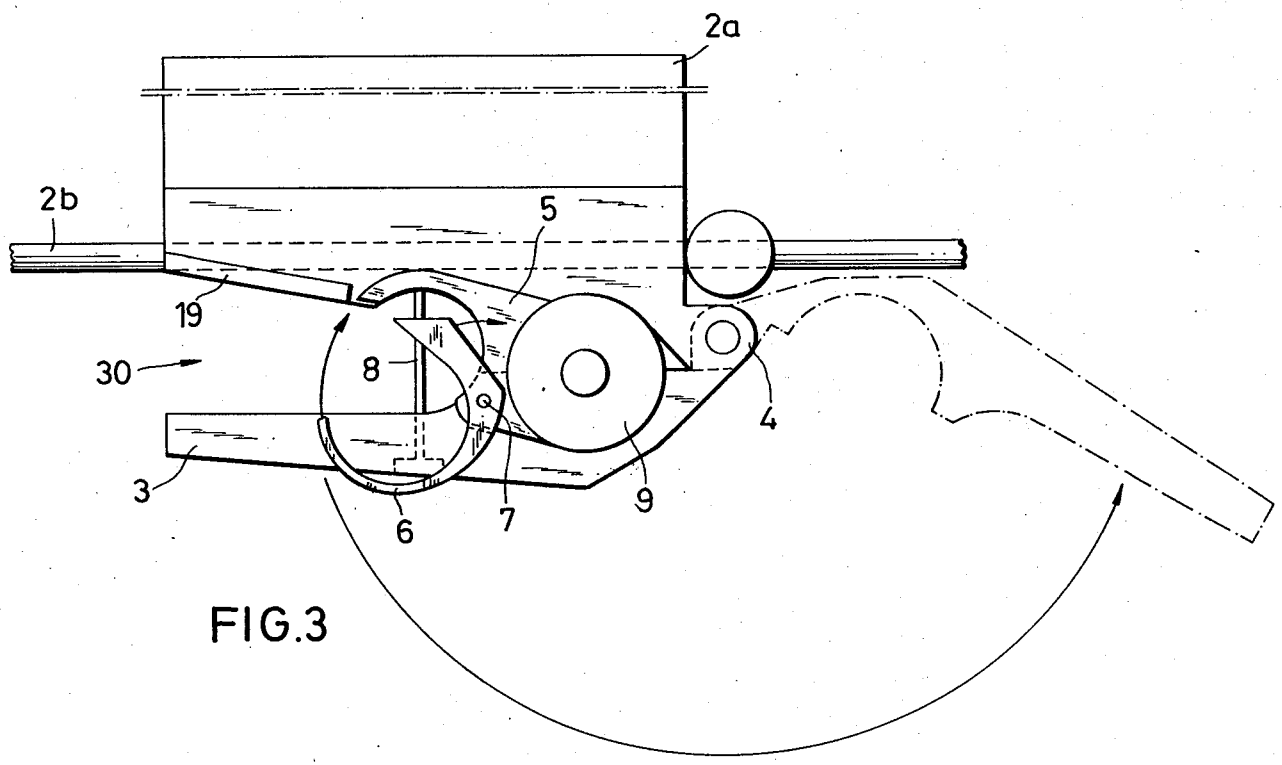
FIG. 3 is a side view of an embodiment of the invention.
Figure 4:
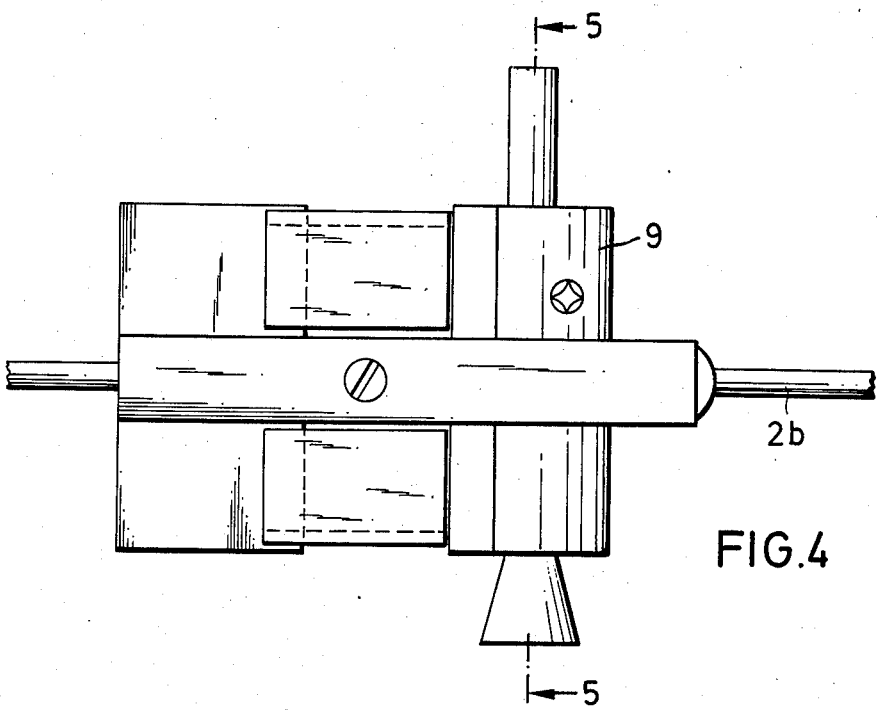
FIG. 4 is a view of the invention as seen from above.
Figure 5:
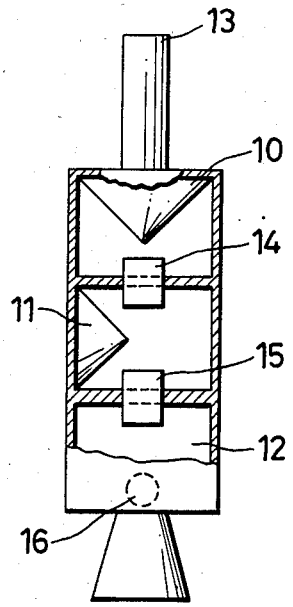
FIG. 5 is a cross-section of the device along the line 5—5 of FIG. 4.
Figures 6, 6A, 6B, 6C:
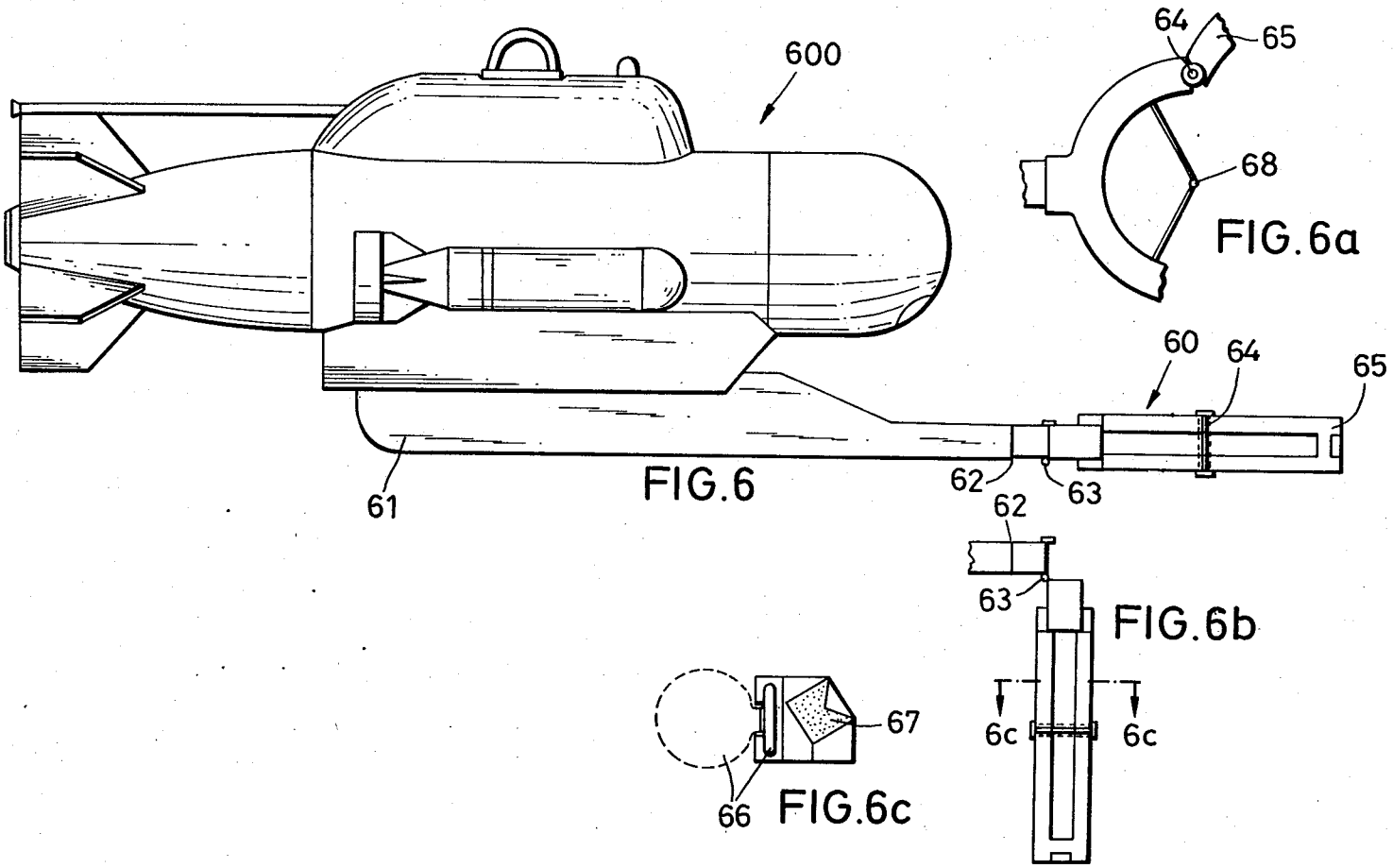
FIG. 6 is a side elevation of another embodiment of the invention.
FIG. 6A is a partial view of a pressure sensitive mechanism for actuating the receiving arms of the embodiment of FIG. 6.
FIGS. 6B and 6C show further details of the invention.

As shown in FIG. 3, bound to the dragging units 2, up to a predetermined breaking point 8, there is a swivel-jointed part 3 which pivots on a hinge. When put to active use, the swivel-jointed part 3, together with dragging units 2, forms a wedge-shaped culvert 30 for taking hold of the cable **100*a*. A floatation device made of encompassing hollow charge carriers 9 is wedged between dragging units 2 and swivel-jointed part 3. A gas generator or a rocket propellant is ideally used as a buoyancy-producing agent. As soon as the cable 100*a* breaks the device at the predetermined breaking point 8, swivel-jointed part 3, as shown by dotted lines in FIG. 3, opens in the direction opposite to the direction in which it is being towed, thus freeing the hollow charge carriers 9, which can separate from the rest of the device 1**.

As part 3 unfolds and opens, a tension pin is pulled off, which frees a spring-pressured firing pin. This in turn ignites the firing pin ignition 16 of the rocket propellant 12. Simultaneously, the cable **100*a* has now reached a half-shell shaped lever 5, pivoting the latter around its fulcrum 7 toward the hollow charge carrier 9. On reaching the contact point at which the cable 100*a* is surrounded in form-locking fashion, a rocking lever 6 is locked in place by a barrier. The rocking lever 6 and the half-shell 5 now form a tube-like casing, which leads the hollow charge carrier 9 by the anchor chain. A rocket propellant 12, ignited immediately, causes the hollow charge carrier 9 to rise; causing a chain reaction involving hollow charges 10 and 11**.

The rocket propellant 12 is placed in the rear section of the hollow charge carrier 9, the propellant 12 being equipped with the firing pin ignition 16, which is pulled off as the lever is rocked to the side, as described above. Between the rocket propellant 12 and a second hollow charge 11, activated from the side, there is a fuse 15, described below.

Upon striking the mine 100, a nose fuse activates a first hollow charge 10, which is pointing upward, and activates in turn, via a detonator 14, the second hollow charge 11. Thus, at virtually the same time, the mine 100 and its cable **100*a*** are destroyed.

Even if the hollow charge carrier 9 was somehow prevented from rising and encountering the mine 100, the device at least assures the destruction of cable 100*a*, so that the mine 100 will rise to the surface, where it can be destroyed by conventional means. This function is achieved by fuse 15, which, after propellant 12 is activated, and with or without a predetermined timing device, will not fail to activate the second hollow charge 11, which operates from the sine to destroy cable 100*a*.

To maximize the effective range of the first hollow charge 10, which is targetted on the mine 100, the charge and/or the walls of the carrier 9 may be advantageously designed to fragment when the charge is activated, thereby contributing to the destruction of mine 100. For this purpose, the charge insert of the hollow charge and/or hollow charge carrier, guided along cable 100*a* by half-shell 5 and rocking lever 6, heads upward to the mine and destroys it on contact via hollow charge 10, so that the explosion and fragmentation occur at point-blank range. When swivel-jointed part 3 wings open, the anchor cable 100*a* is no longer held by the device 1, so that an additional forward movement of the dragging units 2 permits the dragging units 2 to move past the unharmed cable 100*a* before the mine 100 is destroyed. Once the mine 100 is destroyed, the device 1 that is strung next in sequence along line 2*b* will not be activated by the destroyed mine and will be ready to destroy the next mine that is encountered.

A particular advantage of the device according to the invention is that, except for the hollow charge carrier 9, it can be reused after having been activated. To prepare for reuse, it is only necessary to insert a new hollow charge carrier 9 between the dragging units 2 and the swivel-jointed part 3, and to join then together, as described above, by a predetermined break bond. In this manner, a considerable cost savings can be achieved.

In a preferred embodiment, the hollow charge carrier 9 carries a nose fuse comprising a piezo-detonator in its upper part 13, which is turned toward the mine 100. The piezodetonator initiates the ignition of the front or first hollow charge 10 when the upper part 13 strikes the mine 100. Connected to the front first hollow charge 10, but in a separate compartment of the hollow charge carrier, there is a side or second hollow charge 11, the active axis of which is displaced 90 degrees from that of the first hollow charge 10. The active axis of this second charge 11 is directed at the mine cable 100*a*. When the front hollow charge 10 is activated, whereby the mine 100 is destroyed, the second hollow charge 11 is ignited from the side by detonator 14, which in turn results in the destruction of cable 100*a*. As disclosed above, the hollow charges 10, 11 and/or the walls of the carrier 9 may be advantageously designed to fragment when the charge is activated, thereby contributing to the destruction of mine 100.

Another application of the invention is illustrated by FIG. 6 and FIGS. 6*a*–6*c*. In this embodiment, the device 60 (FIG. 6) is ideally sent to encounter the mine by means of a dragging unit comprising a remote-controlled drone 600. The device 60 incorporates a carrier unit 61, with which it is attached to the drone 600. It also incorporates a push-off mechanism 62, which acts to separate the active device 60 from the carrier 61. Finally, a lever mechanism 63 is provided with a hinged arm, allowing drone 600 to swivel the device 60 into a position to eliminate ground mines 110 (FIG. 1).

The device 60 has at least one arm 65 in its front section which pivots around a fulcrum 64. Alternatively, there can be two arms 65 which pivot around two fulcrums 64. When combatting a anchored cable mine 100, the arms 65 are in an open position as the drone 600 with device 60 approaches the cable or chain. In one embodiment, a pressure-sensitive unit 68 may be used to determine that the cable 100*a* is within range of the arms 65. The arms 65 are then swiveled inward on their fulcrums 64, thereby encircling the cable 100*a*. At that point, the push-off mechanism 62 is triggered, which separates the sections 63, 64, and 65 of the device 60 from the carrier body 61 and the drone 600. Simultaneously, a buoyancy-producing device, located in an annular section of the device 60, is activated. The buoyancy-producing device may be in the form of an inflatable floatation unit 66 (FIG. 6*c*), which is inflated by a gas generator or a pressurized gas bottle.

The resulting increased upthrust causes the annular section of the device 60 to move upward along the encircled chain toward the mine 100, which is held by the cable 100*a*. The annular section of device 60 holds a cutting charge 67 (FIG. 6*c*), the effective axis of which is directed radially inward at an angle of approximately 10 to 20 degrees with respect to a level surface. The cutting charge 67 is activated by either a contact detonator, after the device 60 has worked its way up to the mine 100 in encircling fashion, or by a timed detonator, or by remote-controlled detonation using for example a coded acoustic signal. To improve deployment, floatation unit 66 can be protected when at rest by a synthetic covering material.

When combatting ground mines, the annular section of the device 60 remains open and, in this position, is dropped down on the ground mine. The floatation device 66 is not activated, so that when the push-off mechanism 62 is triggered, the annular section of the device 60 remains in place on the ground mine and the drone 600 can be removed. After a predetermined length of time, it is best to activate the cutting charge 67 by means of remote control detonation, thereby destroying the ground mine.

We claim:

1. A versatile apparatus for destroying water mines comprising at least one drive means for moving the apparatus through the water, a carrier removably affixed to the drive means and having forward and rearward portions, an actuable gripping means carried by the carrier, for selectively contacting a part of a mine selected from the group consisting of a cable of a mine and the outer surface of a mine, an actuable buoyancy-producing means carried by the carrier, and at least one detonator-actuated pyrotechnic charge carrier by the carrier for explosive destruction of the mine.

2. An apparatus according to claim 1 wherein the buoyancy-producing means is selected from the group consisting of a rocket propellant, a gas generator, and an inflatable floatation unit.

3. An apparatus according to claim 1 wherein the drive means is selected from the group consisting of a dragging unit and a remote-controlled drone.

4. An apparatus according to claim 2 wherein the drive means is selected from the group consisting of a dragging unit and a remote-controlled drone.

5. An apparatus according to claim 4 wherein the pyrotechnic charge and the buoyancy-producing means are mounted within a cylindrically-shaped unit comprising the carrier, and further comprising at least one movable arm connecting the cylindrically-shaped unit to the drive means in swivel fashion.

6. An apparatus according to claim 5 wherein the arm is connected to the drive means by a bonding connection with a predetermined breaking point being adapted to break upon contact with a mine cable.

7. An apparatus according to claim 1 wherein the pyrotechnic charge and the buoyancy-producing means are disposed within a hollow container comprising the carrier, and wherein the gripping means comprises a fixed and movable arm combination.

8. An apparatus according to claim 1 wherein the apparatus is generally annular in shape and the gripping means comprises pincer-like arms, said arms being movable between an open and a closed position.

9. An apparatus according to claim 8 further comprising a pressure-sensitive mechanism operatively associated with the pincer-like arms.

10. An apparatus according to claim 8 wherein the drive means is a drone and the buoyancy-producing means is an inflatable floatation unit.

11. An apparatus according to claim 9 wherein the drive means is a drone and the buoyancy-producing means is an inflatable floatation unit.

12. An apparatus according to claim 1 wherein the detonator of at least one detonator-actuated pyrotechnic charge is located in the forward portion of the carrier.

13. An apparatus according to claim 1 further comprising at least two pyrotechnic charges, wherein a second charge is located behind a first charge disposed within the forward portion of the carrier, and the second charge having an active axis different from that of the first charge.

14. An apparatus according to claim 1 wherein the detonator is triggered by remote control.

15. An apparatus according to claim 10 wherein the gripping means further comprises a swivel connecting means between the drone and the carrier for advantageously positioning the carrier for contact with a mine.

16. A method of clearing and destroying water mines comprising the steps of moving a carrier having at least one pyrotechnic charge, actuable gripping means, and an actuable buoyancy-producing means through the water, determining whether the mine to be destroyed is a cable mine or a ground mine, in the case of a cable mine, gripping and substantially surrounding the cable with the gripping means, actuating the buoyancy producing means, causing the carrier to rise along a cable, and detonating the pyrotechnic charge to achieve destruction of the mine, the cable, or both, and in the case of a ground mine, contacting the mine with the gripping means and detonating the pyrotechnic charge to achieve destruction of the mine.

* * * * *